United States Patent [19]

Luigi

[11] Patent Number: 4,793,014

[45] Date of Patent: Dec. 27, 1988

[54] PROCESS AND MACHINE FOR THE TREATMENT, IN PARTICULAR FOR BATCHWISE DYEING, OF LAP-FOLDED FABRICS

[75] Inventor: Chiappini Luigi, Urgnano, Italy

[73] Assignee: M C S Officina Meccanica S.p.A., Bergamo, Italy

[21] Appl. No.: 95,227

[22] Filed: Sep. 11, 1987

[30] Foreign Application Priority Data

May 7, 1987 [IT] Italy ..... 20424 A/87

[51] Int. Cl.[4] ..... D06B 5/22

[52] U.S. Cl. ..... 8/152; 68/177; 68/205 R

[58] Field of Search ..... 68/177, 27, 62, 178, 68/205 R; 8/152

[56] References Cited

U.S. PATENT DOCUMENTS 1,889,048 11/1932 Haggenmacher ..... 68/62

FOREIGN PATENT DOCUMENTS

| | | | |
|---|---|---|---|
| 633955 | 8/1936 | Fed. Rep. of Germany | 68/177 |
| 2949423 | 6/1981 | Fed. Rep. of Germany | 68/177 |
| 2412637 | 8/1979 | France | 68/177 |
| 25351 | 8/1970 | Japan | 68/177 |

*Primary Examiner*—Philip R. Coe

*Attorney, Agent, or Firm*—Bailey & Hardaway

[57] ABSTRACT

For the treatment, especially the dyeing of fabrics, a container is illustrated, which is subdivided into at least two compartments, and is provided, above the compartments, with a motor-driven winch, the direction of which is reversible. The fabric, which can be in rope form, or in open-width form, runs on the winch, and is moved thereby in combination with a system of or nozzles, which spray the dyeing bath onto the fabric. The fabric is anchored on each end at spaced locations in the container which are substantially opposite to each other, in the container area above the compartments, and is made alternately moveable, gathering from either of the compartments into the other one.

25 Claims, 3 Drawing Sheets

PROCESS AND MACHINE FOR THE TREATMENT, IN PARTICULAR FOR BATCHWISE DYEING, OF LAP-FOLDED FABRICS

The present invention relates to a process and to a machine for the treatment, in particular for the batchwise dyeing, of running lengths of fabrics.

It is known that the batchwise dyeing of running fabrics can be carried out by several types of machines, each type being endowed with specific advantages, but also having specific limitations, which do not enable it to be advantageously used in all cases.

The machine of the type denominated "windlass", which proceses a fabric closed to a ring configuration, both in rope form and in open-width form, are substantially provided with a revolving winch, having a polygonal or oval cylindrical shape, which, when installed above a processing vat, lays down the fabric in a folded configuration along a sloping bottom of the vat, then collects it again from the opposite side. The machines of this type can process a plurality of fabrics in rope form, side by side and separated by suitable spacers, dipped inside the same treatment container or beck.

But these machines require bath ratios, ranging from a minimum of 1:20 up to more than 1:100, and represent a negative factor from the standpoint of processes economics.

Furthermore, the treatment times are extended, both because of the slow circulation speed of the fabrics, which are extracted vertically from the bath, due to the pull exerted by the winch, and to the high volumes of the baths to be heated or cooled. The low efficiencies, and the considerable costs of attending personnel limit the value of these machines.

These negative aspects are not present on the machines of the so called "jet" type, in which the dyeing or treatment bath, forced through particular ejectors facing the fabric, is used as the means for moving the fabric in endless configuration. The fabric is made to circulate through a closed container. The advancement speed of the fabric is higher that that of the "windlass" machine, with a consequent reduction of the duration of the processing cycles, and with a higher efficiency. Also the bath ratios are considerably lower, by being generally comprised within the range of from 1:5 to 1:7, which is also advantageous from the viewpoint of the even speed of the fabric. It is possible to treat greater lengths and larger weights of fabric than in the case of the "windlass" type machines.

Despite these appreciable advantages, the fact exists however that these machines are only suitable to treat exclusively fabrics in rope form and, above all, the have drawback that the violence of the bath stream impinging against the fabric, necessary for accomplishing high-speed causes removals of fabric pile, due to the action of the treatment liquid on the fabric being treated.

The just described drawback, and the above said limitation of the machines of the "jet" type are partly overcome with the dyeing machines of the so-said "overflow" type, which, even if resemble, in their outer shape and geometric characteristics, the "jet"-type machines, are equipped with lower-capacity ejectors, which have simpler shapes, and are often as simple as funnels or chutes.

In these machines, the task of fabric driving is accomplished by the combined action of a winch and of the treatment, or dyeing, bath, pumped in a direction concurrent to that of the fabric. The advantage is hence achieved of a more gentle processing, and hence the safeguarding of the more delicate fabrics.

On the other hand, the bath ratios in these machines are not as low as those used in the "jet" machines, and are generally comprised within the range of from 1:8 to 1:12.

Also the fabric results speed results is lower, with consequent longer treatment times, and higher end costs.

In addition, the dyeing of travelling fabrics may also be carried out by means of machines of the so-said "jigger" type, which treat fabric in open-width form, alternately passing it, inside a dyeing bath, from one winch to another one, with several cycles of alternate winding first on one, and then on the other winch.

By operating in both travelling directions, the passage of the dyeing liquid, or of the treatment liquid through the textile interlacement is facilitated, thus reaching a more uniform dyeing or treatment level.

But these machines can only handle open-width fabric, perfectly flat and with a minimum tension, essential for the proper functioning of the stretchers.

A purpose of the present invention is to obviate the limitations of the prior art, by proposing a process and a machine, in particular for the dyeing of fabrics, which is suitable to treat both fabric in rope form and in open-width form, and which, with low bath ratios, makes it possible to rapidly carry out a uniform treatment, safeguarding the fabric against tension and friction.

Another purpose of the present invention is to provide a process and a machine of the specified type, which can be used, without modifications, for a very wide range of types, weights and compositions of fabrics, with knitted fabrics being included.

Still another purpose of the invention is to provide a machine of the specified type, which involves a simplicity in the movement of fabric charging and discharging, and furthermore makes it possible that the energy consumptions be considerably reduced relative to the machines of the prior art.

In view of these purposes, according to the invention a process is proposed for the treatment, in particular for the batchwise dyeing, of fabrics, wherein the fabric is treated inside a treatment container or vat, by being collected from one part of the vat and being laid down in another part of the vat, and undergoes the action of the treatment liquid during its movement inside the container, characterized in that the fabric is kept fixed at its ends, inside the container, and is alternately gathered inside the one, and the other part of the container, with it being contacted by the treatment medium during the step of passage from either part to the other part of the container.

For the purpose of practically embodying this process, a machine is provided according to the invention, which comprises a treatment container or vat, and a motor-driven winch performing the task of moving the fabric from either part to the other part of the container, the fabric undergoing the action of a treatment liquid during its movement inside the container, characterized in that inside the container means are provided for fastening the two ends of the fabric, and that the winch can be alternately driven opposed directions, for lifting the fabric from one part of the container, and then laying it down in the other part of the container, and vice-versa, along the route of the fabric between said two parts of the container means being provided for delivering the treatment liquid to the fabric.

The characteristics and advantages of the present invention may be better understood from the following disclosure of an example of a preferred, but not exclusive, form of practical embodiment of the invention, shown in the hereto attached drawings wherein.

Figure 1:
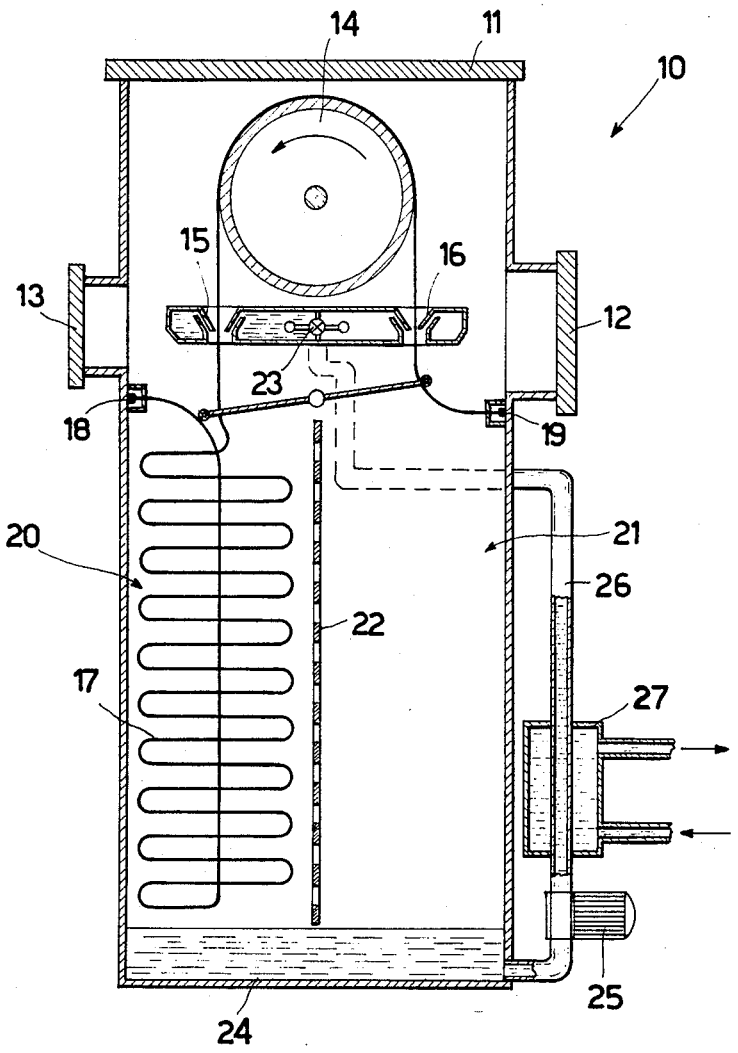
FIG. 1 shows a schematic transverse sectional view of a machine according to the invention, with the fabric being folded to a lap configuration, and gathered inside one of the two interior compartments which subdivide the container into two parts.
Figure 2:
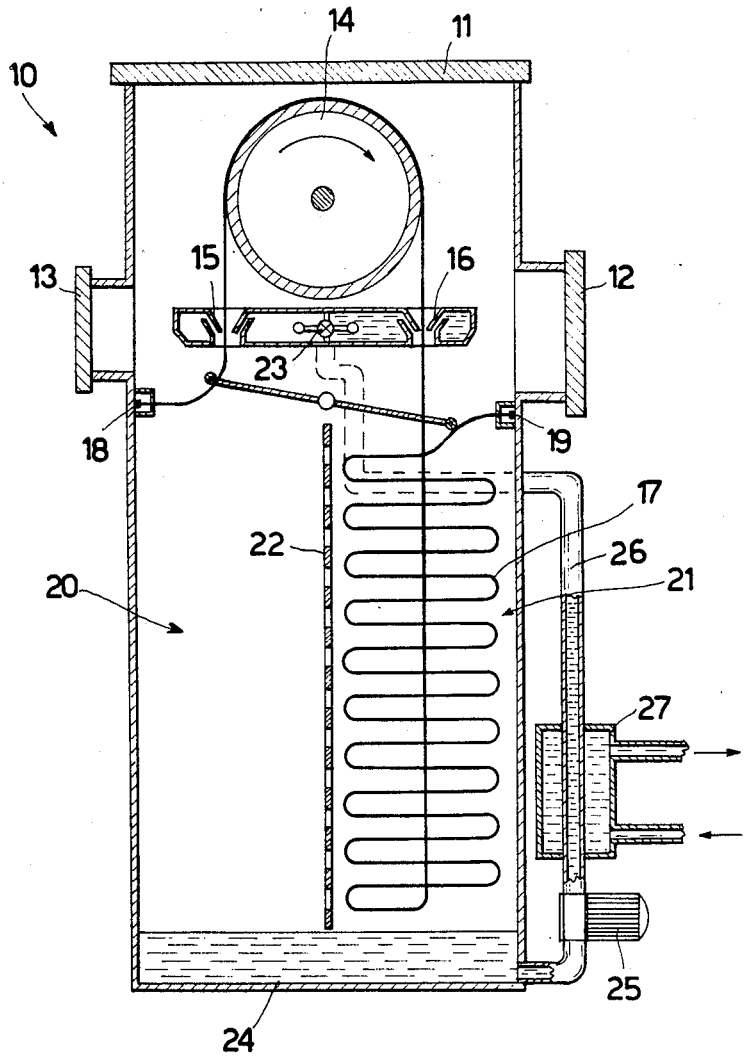
FIG. 2 shows the machine of FIG. 1, with the fabric being folded to a lap configuration, and gathered in the compartment opposite to the compartment of FIG. 1.

Referring to FIGS. 1 and 2, a machine for the treatment of a running length of fabric according to the present invention comprises a container, preferably of generally rectangular shape, broadly indicated at 10, and preferably provided with a top cover 11. Advantageously, the container 10 is positioned with its axis being vertical.

The container 10 shows, in two opposite side areas, two openings, preferably closeable, such as at 12 for entering the container and charging the fabric to it, and a porthole 13 for accessing the container 10 and performing the necessary operations.

Inside the container 10, in the upper portion of the container, a motor-driven winch 14 is provided, which, together with the ejectors or applicators 15 and 16, positioned beneath the winch 14, on opposite sides relatively to the vertical middle plane of the winch, performs the task of transporting the fabric 17 to be processed. Said fabric 17 is not closed in endless configuration, but is constrained at both of its ends to two fixed points by means or leaders of suitable fastening means 18 and 19 inside the container 10, provided on diametrically opposite sides in the upper portion of the container 10, under the winch 14, respectively adjacent of the porthole 13 and of the opening 12. As can be seen in the drawing, the two systems of ejectors 15 and 16 are positioned at an intermediate level between the winch 14 and the fastening means 18 and 19, along the route which the fabric 17 travels.

Under the motor-driven winch 14 and the ejectors 15 and 16, the container 10 is advantageously subdivided into at least two compartments 20 and 21 by a vertical wall 22, preferably perforated, which extends down to a point slightly above the bottom of the container 10.

The ejectors 15 and 16 are alternatively fed the same dyeing liquid, according to the position of a three-way valve 23 associated with the ejectors.

The treatment liquid is sprayed by the ejectors 15 and 16 and collected in a region 24 on the bottom of the container 10 and then, by means of a pump 25, is recycled through a pipe 26 which reaches the valve 23. With the pipe 26, a heat exchanger 27 is associated, in order to heat/cool the treatment liquid to the necessary temperature for the type of treatment to be carried out, during both the heating and cooling steps.

The winch 14 can be alternately actuated in either direction of revolution, by being associated, e.g., with motor means (not shown) or a reversible type. The reversal of the direction of revolution of the winch 14 takes place in concomitance with the reversal of the position of the distribution valve 23, in such a way that when the winch 14 revolves in a certain direction (FIG. 1 or FIG. 2), the valve 23 delivers the liquid to that one of the ejectors 15 or 16, which forces the liquid to the direction concurrent with the direction of travelling of fabric 17.

The treatment of the fabric by means of the disclosed machine takes place as follows.

An end of the fabric 17 to be treated is introduced inside the container 10, through the opening 12, is laid down upon the winch 14, and is inserted through the ejector 15, using the opening provided by the porthole 13.

At this point, the winch 14 is started up; it makes it possible to recover the end of the fabric 17, and to hook it at 18. Then, with the aid of the bath solution delivered by the pump 25 into the ejector 15, the laying down the fabric 17 in the form of wet laps inside the compartment 20 of the container 10 is attained, while the fabric 17 continues to be fed from the outside through the opening 12, which remains open.

After the loading is completed, the rear end of the fabric 17 is hooked at 19, after being inserted inside the ejector 16. When these operations have been finished, the machine is ready to operate. The winch 14 is now driven in the opposite direction, and only the ejector 16 starts operating, which contributes to continuously move the fabric, which, while is being soaked with the treatment liquid, gathers inside the compartment 21, emptying the compartment 20 (FIG. 2).

At the end of passage of fabric 17 from compartment 20 to compartment 21, the direction of revolution of the winch 14 is reversed, and the ejector 15 starts operating, with the result that the fabric is brought back into the compartment 20, and so on, for a determined number of times, pre-established as a function of the type of treatment and/or of the type of fabric, or of other parameters. The fabric 17 is hence alternately gathered inside the one, and then inside the other, part of the container, while it is kept fixed at its ends inside the container 10, and is treated with the treatment medium during its passage from one side to the other side of the container 10.

Figure 3:
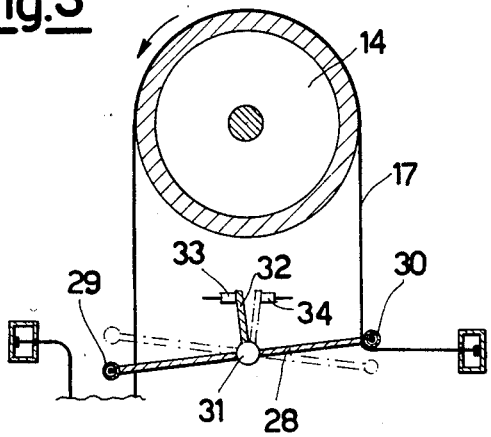
FIG. 3 shows a schematic view of a possible electromechanical control means for the automatic reversal of the fabric travelling direction.

The reversal of the direction of revolution of the winch 14, and the switching of the valve 23 can taken place also automatically, as a function of the position of the fabric, by being controlled by the same fabric at the end of the gathering inside the one, or inside the other, of the compartments 20, 21. For example, as shown in FIG. 3, under the ejectors 15 and 16, a rocker arm 28 can be provided, positioned symmetrically relatively to the vertical middle plane of the winch 14, at the ends of said rocker arm 28 guide rollers 29 and 30 for the fabric 17 being provided. With the rocker 28 pivoted upon is, the fulcrum 31 thereof, a movable element 32 of an electrical contact, which, according to the position of the rocker arm, closes on the one, or on the other one, of two stationary contacts 33, 34, a circuit which actuates the valve 23 and of the motor means of the winch 14 respectively in the one, or in the other direction. The shift of the rocker arm 28 is caused by the same fabric at its stroke end, due to the tension of the fabric in that position.

Figure 4:
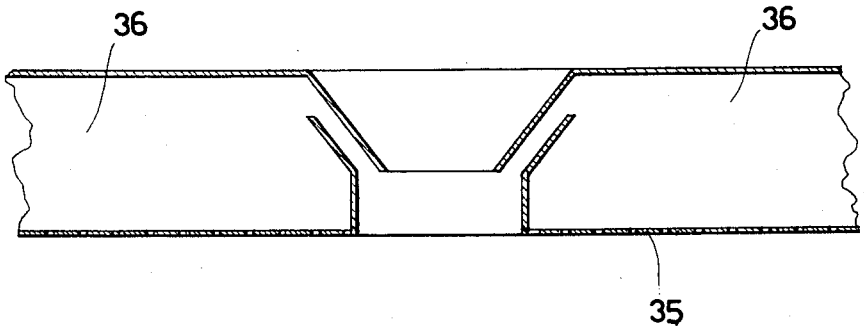
FIG. 4 shows a schematic sectional view of an ejector for soaking the fabric in modified form of the invention.

In FIG. 4, a form of ejector is shown, which can be advantageously used in the machine as disclosed, and wherein the bottom walls 35 of the collection chambers 36 for the pressurized liquid exiting the ejectors are perforated for the purpose of sprinkling the fabric 17. It is thus possible to sprinkle the fabric in a more uniform way, while the filling of the respective compartments 20 or 21 with the rope or open width fabric in folds or laps is taking place. The share of sprinkled bath, relatively to that pumped to the ejectors 15 or 16 may vary within a wide range, e.g., from 20 to more than 50% of the total.

From the above disclosure, one can understand that by a process and a machine according to the invention, the bath ratios are advantageously reduced, being adjusted to the minimum volumes strictly necessary to supply the ejectors of the machine, and to treat the fabric. In fact, the fabric is no longer left dipped or immersed inside a bath advancing at its same speed, as it occurs in the machines of the prior art, previously disclosed. But the fabric may be continuously treated by the medium which exits the ejectors and which may reach the bottom of the container.

The small bath ratios make possible the filling and emptying times, on bath changes, to be limited to the minimum, and it is furthermore possible to increase the bath heating or cooling rate, with the exchange surface of the heat exchanger being the same. The bath volume necessary for an optimum function is given by the sum of the volume absorbed by the fabric, plus the volume contained inside the pipes and inside the ejector-pump system, plus that necessary for reaching the level to feed the circulation pump. In total, approximately 3 to 4 times the weight of the fabric, for an average machine charge. In practice, bath ratios lower than 1:4 can be reached, independently from the lengths and the weights of the fabrics.

The continuous reversing of the direction of travelling of the fabric produced by the reversible winch 14 in combination with the operation of ejectors 15 and 16 which may be alternate, secures an optimum evenness of treatment of the fabric, notwithstanding the changes in temperature and in characteristics of the individual baths, which may occur during the cycles.

Since the fabric laid down vertically relatively to the wet layer, but not "under bath", and due to the continuous reversing of the movement direction, the causes of formation of knots and irregular windings are removed, with the further advantage of the increase in the speed of the fabric.

Another important advantage of the present invention is that sewing the fabric to close it to a ring configuration for the treatment is no longer necessary, but the fabric is left "open", anchored or otherwise maintained at its ends, and is not made endless. In this way, the operations of machine loading unloading are made quicker, and the problem no longer exist, of having to find the sewing point during the sampling operations, and when the fabric is discharged from the machine. The treatment times are reduced. Utilizing a machine according to the invention, travelling speeds of the fabrics higher than 500 m/minute can be attained.

As distinguished from the above described machines of the windlass, jet or overflow type, in machines according to the invention, not only is the fabric substantially vertically drawn from a side of the container, but it is also laid down in substantially vertically overlapping laps in the other side of the container, a fact this, which makes it possible the fabric to be continuously soaked by the liquid exiting the ejectors, securing an efficiacious impregnation of the fabric, in particular in a case wherein due to the action of the ejectors, the "sprinkling" action according to the embodiment of FIG. 4 is added.

The particular modality of treatment according to the present invention makes it possible to treat a very wide range of fabric types, with different weights and compositions. In particular, it is possible to treat or dye fabrics in rope form, as well as fabrics in open-width form. In an analogous way, knitted fabrics can be treated.

The fabric is treated delicately, without excess friction or tension.

The disclosed process and machine can be variously modified, without exceeding the scope of the claims. Thus the container could have the shape of an open vat. It could also be an autoclave for treating the fabric in a pressurized environment, e.g., under a pressure of four bars. The ejectors 15 and 16 could be of adjustable-capacity type. The system for producing direction reversal could be also driven by means of a timer.

I claim:

1. Process for the batchwise treatment of fabrics, wherein the fabric is treated inside a treatment container by being collected from one stationary part of the container and being laid down in another part of the container, and undergoes the action of a treatment fluid during its movement inside the container, comprising keeping the respective fabric ends inside respective parts of the container, providing driven transport means having a stationary tangential substantially vertical fabric delivery on respective sides thereof in combination with a stationary nozzle substantially vertically below each respective delivery above each of said respective parts of said container for treating said fabric with fluid, alternately gathering said fabric inside said one, and said another part of the container, with said fabric being treated during said gathering from said one part to said another part of the container including lifting the fabric substantially vertically from said one stationary part of the container by passing the fabric about said transport means which turns alternately in opposite directions, and laying down the fabric substantially vertically in said another stationary part of the container.

2. Process according to the claim 1, including soaking the fabric with a treatment liquid while it is being laid down.

3. Process according to claim 1 including collecting a treated fabric inside a pressurized environment.

4. Process according to claim 1 wherein fabric laid down in the container is sprinkled with treatment liquid.

5. Process set forth in claim 1 wherein the fabric is laid down in lap-folded form.

6. The process set forth in claim 1 wherein the fabric is laid down in rope form.

7. The process set forth in claim 1 including actuating respective nozzles successively as the transport means turns alternately in opposite directions so that the nozzle adjacent the delivery of the fabric above the part of the container receiving fabric is operable while the other nozzle is inoperable.

8. Machine for treating fabrics comprising:

a treatment container having at least two stationary parts;

a winch rotatable about a stationary axis over which the fabric is moved from one stationary part to another stationary part of the container;

a stationary tangential substantially vertical fabric delivery on respective sides of said winch;

means subjecting the fabric to the action of a treatment medium during its movement inside the container including a stationary nozzle substantially vertically below each respective delivery above each of said respective parts of said container for treating said fabric with fluid;

means for maintaining the two ends of the fabric in respective parts of the container such that the winch can be alternately driven in opposite directions;

said winch lifting the fabric substantially vertically from one part of the container, and laying it down substantially vertically in the other part of the container, and vice-versa, whereby the fabric is treated along the route of the fabric between said parts of the container means.

9. Machine according to claim 8 wherein the container is vertically subdivided into two compartments respectively defining said parts.

10. Machine according to claim 8, wherein the winch is driven by motor means, which are automatically reversible as a function of the position of the fabric.

11. Machine according to claim 8, including a distribution valve associated with said nozzles, for the alternating delivery to the one, and to the other one of the nozzles, as a function of the direction of revolution of the winch.

12. Machine according to claim 11, including a motor means for driving said winch and wherein said valve and said motor means are controlled by the fabric at the end of the gathering inside the respective parts of the container.

13. Machine according to claim 11, wherein the means for fabric maintaining are provided on opposite sides inside an upper portion of the container, beneath the winch.

14. Machine according to claim 11, wherein said nozzles are located at an intermediate level between said winch and said maintaining means.

15. Machine according to claim 11, wherein adjacent said maintaining means the container is provided with respective openings of intervention and inspection.

16. Machine according to claim 11 wherein said container is a substantially rectangular container, with its axis being in a vertical direction.

17. Machine according to claim 11 wherein said container is an autoclave.

18. Machine according to claim 11 wherein the bath ratio is lower than 1:4.

19. Machine according to claim 11 wherein means are provided for recycling the treatment liquid between the bottom of the container, and said nozzles.

20. The method of dyeing a length of fabric comprising the steps of:

depositing said length of fabric in a stationary container;

providing driven transport means having a stationary tangential substantially vertical fabric delivery on respective sides thereof in combination with a stationary nozzle substantially vertically below each respective delivery;

lifting the fabric substantially vertically in running length from one stationary part of the container by said transport means;

continuing to move the fabric in running length substantially vertically downwardly from a stationary tangential delivery in a substantially tensionless state while applying a dyeing liquid from a stationary nozzle to said fabric and depositing same in another part of the container;

then reversing the direction of movement of the fabric again lifting the fabric upwardly in running length from said another part of the container; and then again applying a dyeing liquid to said fabric while continuing to move said fabric in running length, prior to depositing same vertically in said one part of the container;

whereby a dyeing liquid may be applied evenly and without immersion during application thereof.

21. The method set forth in claim 20 including supporting the fabric upon a winch for lifting and moving the fabric.

22. The method set forth in claim 21 wherein said winch is driven the direction of which it is reversed for repeating the lifting of the fabric, applying a dyeing liquid and depositing the fabric.

23. Apparatus for dyeing a length of fabric comprising:

a liquid container;

a partition dividing said container into at least a pair of stationary vertical compartments;

a power operated transport means having a stationary axis and a stationary tangential substantially vertical fabric delivery on respective sides thereof alternately moving said fabric from one of said compartments into the other of said compartments;

a nozzle carried substantially vertically below each of said deliveries fixed with respect to said compartments each receiving said fabric and delivering same into one or the other of said compartments;

pump means collecting liquid from respective compartments so that substantially no liquid remains therein to impede the fall of the fabric and returning collected liquid to at least one of said nozzles;

whereby said fabric may be dyed while being conveyed rapidly from one compartment to the other without substantial tension.

24. The structure set forth in claim 23 wherein said fabric is delivered from said nozzles in rope form.

25. The structure set forth in claim 23 wherein said power operated transport means is a winch.

* * * * *